United States Patent [19]

Yoshida et al.

[11] Patent Number: 4,880,054

[45] Date of Patent: Nov. 14, 1989

[54] HEAT EXCHANGER TUBE FOR EVAPORATION OR CONDENSATION

[75] Inventors: Takayuki Yoshida, Shizuoka; Masao Fujii, Chuo; Kiyoshi Sakuma, Shizuoka, all of Japan

[73] Assignee: Mitsubishi Denki Kabushiki Kaisha, Tokyo, Japan

[21] Appl. No.: 241,477

[22] Filed: Sep. 7, 1988

Related U.S. Application Data

[62] Division of Ser. No. 141,509, Jan. 7, 1988, Pat. No. 4,794,983.

[30] Foreign Application Priority Data

Feb. 2, 1987 [JP] Japan ..... 62-22113

[51] Int. Cl.[4] ..... F28F 13/00

[52] U.S. Cl. ..... 165/133; 165/913; 165/179

[58] Field of Search ..... 165/911, 179, 913, 133; 138/38

[56] References Cited

U.S. PATENT DOCUMENTS

| | | | |
|---|---|---|---|
| 3,088,494 | 5/1963 | Koch et al. | 165/133 X |
| 3,358,750 | 8/1966 | Thomas | 165/913 X |
| 3,598,180 | 8/1971 | Moore, Jr. | 165/133 |
| 4,291,758 | 9/1981 | Fujii | 165/133 |

FOREIGN PATENT DOCUMENTS

| | | | |
|---|---|---|---|
| 041316 | 3/1980 | Japan . | |
| 6047195 | 3/1982 | Japan | 165/913 |
| 0066696 | 4/1984 | Japan . | |
| 0100398 | 6/1984 | Japan . | |
| 6123065 | 6/1986 | Japan . | |
| 61-61039 | 12/1986 | Japan . | |
| 0003664 | 12/1984 | United Kingdom . | |

OTHER PUBLICATIONS

Thomas, D. G., I&EC Fandam., 6-1 (Jun. 1967), 97.
Gregorin, R. Z., Angew, Math, Phys. 5-1 (1954-1), 36
"Heat Transfer Enhancement for Gravity Controlled Condensation on a Horizontal Tube by a Coiled Wire".
"Nucleate Pool Boiling Heat Transfer from Porous Heating Surface (Optimum Particle Diameter).".

*Primary Examiner*—Robert E. Garrett
*Assistant Examiner*—Carl D. Price
*Attorney, Agent, or Firm*—Oblon, Spivak, McClelland, Maier & Neustadt

[57] ABSTRACT

A heat exchanger tube for evaporation or condensation, comprising:

projected parts having cavities and provided on at least one of the inner wall surface and the outer wall surface of a tubular body, and plain parts formed on the same surface as the projected parts so that the projected parts and the plain parts mingle together.

1 Claim, 6 Drawing Sheets

HEAT EXCHANGER TUBE FOR EVAPORATION OR CONDENSATION

This is a division of application Ser. No. 07/141,509, filed Jan. 7, 1988 Pat. No. 4,794,983.

FIELD OF THE INVENTION

The present invention relates to a heat exchanger utilized in a heat pump type of air-conditioning and heating apparatus and so forth and, more particularly, to an improved heat exchanger tube for evaporation or condensation.

BACKGROUND OF THE INVENTION

Plate-fin tube type of heat exchangers 3 comprising aluminum fins 1 and heat exchanger tube 2 as shown in FIG. 14 have been widely used as a heat pump type of air-conditioning and heating apparatus and so forth. A fluorinated hydrocarbon type of refrigerant such as R-22, R-11 and so on flows through the tube 2 to carry out heat exchanging operation with air passing between the fins 1. In such heat pump type of air-conditioning and heating apparatus, a single heat exchanger 3 functions as a condensor for heating operation in winter and also as an evaporator for cooling operation in summer. This means that the tube 2 is subjected to heat transfer with condensation in winter and heat transfer with evaporation in summer.

There has been known a method for preparing a heat exchanger tube having a porous layer formed by aluminum type sintered metal plate as disclosed in Japanese Examined Patent Publication No. 23065/1986 in order to improve evaporating heat transfer characteristics in the conventional heat exchanger tube 2. According to such method, the porous layer plate made of aluminum type sintered metal is metallically bonded on the wall surface of the tube 2 through alloying bonding material as shown in FIG. 15 to form the porous layer 4 on the entire wall surface of the tube 2. An evaporated refrigerant is captured in cavities formed in the porous layer 4 to work as bubble nuclei so as to accelerate the generation of bubbles. That helps excellent heat transfer characteristics to be obtained. With respect to "Nucleate Pool Boiling Heat Transfer from Porous Heating Surface", "Transactions of the Japanese Society of Mechanical Engineering (Part B) vol. No. 50, 451 (1984-3)", page 818, describes that the porous layer 4 is formed by bonding spherical metal particles having uniform particle size on the entire plain or smooth wall surface of the heat exchanger tube by means of electroplated film so as to obtain excellent bubble nuclei boiling heat transfer characteristics.

On the other hand, there have been known two methods for improving condensing heat transfer characteristics in the tube 2. One is a method for increasing heat transfer area by forming grooves 5 in the inner wall surface 2*a* of the tube 2 as shown in FIG. 16. The other is a method for improving condensing heat transfer characteristics by coiling a single steel wire 6 on and around the entire outer wall surface 2*b* of the tube 2 for heat transfer with condensation as shown in FIG. 17 (see page 2436 of "Transactions of the Japanese Society of Mechanical Engineering (Part B) vol. 51 No. 467 (1985-7)").

A heat exchanger tube utilized in the heat pump type of air-conditioning and heat apparatus is required to improve both evaporating heat transfer characteristics and condensing heat transfer characteristics.

When the tube 2 having the porous layer 4 as shown in FIG. 15 is utilized as a condensor, it is inferior to the tube 2 with the grooves 5 in its inner surface 2*a* as shown in FIG. 16 in terms of condensing heat transfer characteristics because condensate is held in the cavities in the porous layer 4 by capillary effect and is unapt to leave, and the liquid film functions as heat resistance. On the other hand, when the tube 2 with the grooves 5 as shown in FIG. 16 is utilized as an evaporator, it is quite inferior to the tube 2 with the porous layer 4 as shown in FIG. 15 in terms of evaporating heat transfer characteristics, though it is possible to improve the evaporating heat transfer characteristics in respect of the increment of the heat transfer area. It has a disadvantage that it can not improve both evaporating heat transfer characteristics and condensing heat transfer characteristics.

OBJECT OF THE INVENTION

It is an object of the present invention to eliminate the disadvantage as described above and to provide an improved heat exchanger tube for evaporation or condensation capable of improving both evaporating heat transfer characteristics and condensing heat transfer characteristics.

It is another object of the present invention to provide an improved heat exchanger tube for evaporation or condensation capable of increasing the mass productivity.

SUMMARY OF THE INVENTION

The foregoing and other objects of the present invention have been attained by providing a heat exchanger tube for evaporation or condensation comprising projected parts having cavities therein and formed on at least one of the inner wall surface and outer wall surface of a tubular body, and plain parts formed on the same surface as the projected part so that the projected parts and the plain parts are mingled together.

The projected parts according to the present invention have cavities therein and can capture evaporated refrigerant in them when the tube is utilized as an evaporator. The captured evaporated refrigerant functions as bubble, nuclei and accelerates the generation of bubbles thereby improving evaporating heat transfer characteristics. On the other hand, when the tube is used as a condensor, the provision of the projected parts increase the heat transfer area, thins the film of condensate on the plain parts of the tube wall surface by capillary effect, and minimizes heat resistance, thereby improving the condensing heat transfer characteristics.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein:

FIG. 3 is a fragmentary longitudinal section illustrating the relationship between projected parts in a heat exchanger tube and a film of the condensate, FIGS. 4(*a*) and 4(*b*) illustrate a second embodiment wherein projected parts are scattered in a stagger on the inner wall surface of the tube, wherein FIG. 4(*a*) is a fragmentary longitudinal cross section and FIG. 4(*b*) is a transverse cross section taken along line IV-IV of FIG. 4(*a*), FIGS. 5(*a*) and 5(*b*) illustrate a third embodiment, wherein FIG. 5(*a*) is a fragmentary longitudinal cross section showing the state of the provision of the projected parts on the inner wall surface in a spiral form and FIG. 5(*b*) is a transverse cross section taken along line V—V of FIG. 5(*a*), FIGS. 6(*a*) and 6(*b*) illustrate a fourth embodiment, wherein FIG. 6(*a*) is a fragmentary longitudinal cross section showing how projected parts are provided on the inner surface of the tube in the axial direction and FIG. 6(*b*) is a transverse cross section taken along line VI—VI of FIG. 6(*a*), FIGS. 7(*a*) and 7(*b*) are schematic views illustrating a shell and tube type of heat exchanger employed in a heat pump type of air-conditioning and heating apparatus, wherein FIG. 7(*a*) is a schematic longitudinal cross section and FIG. 7(*b*) is a schematic transverse cross section taken along line VII—VII of FIG. 7(a), FIGS. 8(*a*) and 8(*b*) illustrate a fifth embodiment, wherein FIG. 8(*a*) is a fragmentary longitudinal cross section showing how the projected parts are provided on the outer wall surface of the tube and FIG. 8(*b*) is a transverse cross section taken along line VIII—VIII of FIG. 8(*a*), FIGS. 9(*a*) and 9(*b*) illustrate a sixth embodiment, wherein FIG. 9(*a*) is a fragmentary longitudinal cross section showing how the projected parts are scattered on the outer wall surface in a stagger and FIG. 9(*b*) is a transverse cross section taken along line IX—IX of FIG. 9(*a*), FIGS. 10(*a*) and 10(*b*), FIGS. 11(*a*) and 11(*b*), and FIGS. 12(*a*) and 12(*b*) illustrate a seventh to a ninth embodiment, wherein each FIG. (*a*) is a fragmentary longitudinal view showing how a stranded wire or wires made of a plurality of steel wires forms or form the projected parts on the inner wall surface of the tube, corresponding to FIG. 1(*a*), FIG. 5(*a*) and FIG. 6(*a*), and each FIG. (*b*) is a transverse view taken along line X—X, XI—XI or XII—XII, corresponding to FIG. 1(*b*), FIG. 5(*b*) and FIG. 6(*b*), FIGS. 13(*a*) and 13(*b*) illustrate a tenth embodiment, wherein FIG. 13(*a*) is a fragmentary longitudinal cross section showing how the projected parts formed by the stranded wire are provided on the outer surface of the tube in a spiral form and FIG. 13(*b*) is a transverse cross section taken along line XIII-XIII of FIG. 3(*a*), FIGS. 14(*a*) and 14(*b*) illustrate the conventional plate-fin tube type of heat exchanger, wherein FIG. 14(*a*) is a schematic front view and FIG. 14(*b*) is a side view, FIGS. 15(*a*) and 15(*b*) illustrate the structure of a conventional heat exchanger tube, wherein FIG. 15(a) is a fragmentary longitudinal cross section showing how the porous layer is formed on the inner wall surface of the tube and FIG. 15(*b*) is a transverse cross section, FIGS. 16(*a*) and 16(*b*) illustrate a conventional condensing tube, wherein

DETAILED DESCRIPTION OF THE PRESENTLY PREFERRED EMBODIMENTS

Figure 1A:
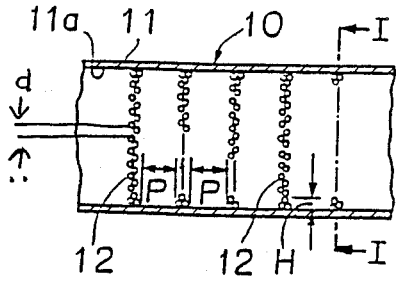
FIGS. 1(*a*) and 1(*b*) are sectional views of a first embodiment of a heat exchanger tube for evaporation or condensation according to the present invention, wherein FIG. 1(*a*) is a fragmentary longitudinal cross section and FIG. 1(*b*) is a transverse section taken along line I—I of FIG. 1(*a*).
Figure 1B:
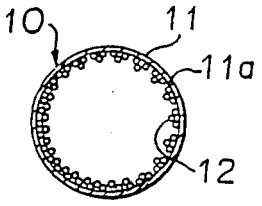

Now, a first embodiment of a heat exchanger tube for evaporation or condensation according to the present invention will be described in detail with reference to FIGS. 1(*a*) through 3. In FIGS. 1(*a*) through 3, a reference numeral 10 designates a heat exchanger tube utilized in a heat exchanger. The tube 10 has projected parts 12 formed by a porous layer. The porous layer is deposited on the inner wall surface 11(*a*) of a tubular body 11 in the form of multi-layer by bonding aluminum type sintered metal, or coating fluorocarbon resin or a thin metallic film. The projected parts 12 are provided in an annular form in the circumferential direction at intervals P between the projected parts 12 ajoining in the axial direction of the tubular body 11.

In this embodiment, the area with the projected parts 12 of the porous layer formed thereon accelerates the generation of bubbles in a conventional manner to obtain quite excellent heat transfer characteristics of the tube 10. On the other hand, although the area without the projected parts 12 has slightly poorer heat transfer characteristics than the area with the projected parts, the decrease in the heat transfer characteristics can be ignored because the evaporating heat transfer coefficient is extremely high in comparison with other heat transfer without phase change, due to the latent heat transfer effect of bubbles and the disturbing effect of the refrigerant around the bubble caused by the generating of or leaving the collapse of bubbles and because the latter effect is remarkable when heat flux is small as in the use of a heat pump. If the intervals P as shown in FIG. 1 are less than twice the diameter d of a bubble, or satisfies the expression (1) as described below, the decrease in the heat transfer coefficient can be ignored on the area without the projected parts 12 formed by a porous layer:

$$P \leqq 4d \tag{1}$$

That is because the area which receives the disturbing effect by the generating and collaspsing of bubble is considered to be almost twice the diameter d of the bubbles.

In the expression (1), d is obtained by the following equation (see "DENNETSU GAIRON" the equation 15.5 on page 306 written by Yoshio Koudo and published by Yokendo shuppan):

$$d = 0.029\phi\sqrt{\frac{\sigma}{g(\rho_e - \rho_\gamma)}} \tag{2}$$

wherein $\phi$ is a contacting angle when a bubble leaves, $\sigma$ is the surface tension, $\rho_e$ and $\rho_\gamma$ are the densities of a liquid and a gas, and g is the gravitational acceleration.

In heat pump type of evaporators, the refrigerant at the output of an evaporator is usually superheated steam in order to the refrigerant from being liquidized and returning to the compressor. The tube with the superheated steam flowing therethrough has had extremely poor heat transfer coefficient in comparison with the evaporating heat transfer because single phase convective heat transfer by the steam is caused in the tube. However, the tube 10 according to the present invention can obtain enough improved heat transfer characteristics even at the superheated area because the projection arrays on the projected parts 12 formed by a porous layer accelerate turbulence. Tests have proved that the effect of the projection arrays as the turbulence accelerator takes the maximum heat transfer coefficient when the following inequality is satisfied:

$$10 \leqq P/H \leqq 20 \quad (3)$$

wherein H represents the height of the projection arrays of the projected parts 12.

Figure 2A:
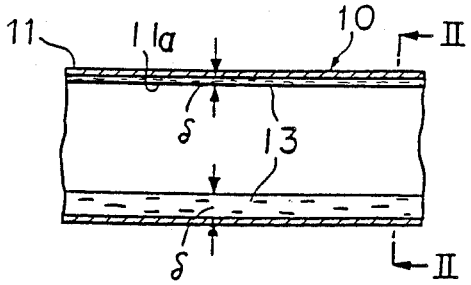
FIGS. 2(*a*) and 2(*b*) illustrate the state of the flow of condensate in a heat exchanger tube with a plain inner surface, wherein FIG. 2(*a*) is a fragmentary longitudinal cross section and FIG. 2(*b*) is a transverse section taken along line II—II of FIG. 2(*a*)
Figure 2B:
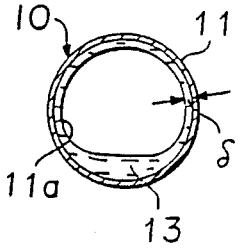

Now, the condensing heat transfer characteristics of the tube 10 will be considered. The condensing heat transfer coefficient h can be given by the equation:

$$h = k/\delta \quad (4)$$

wherein k designates the heat transfer coefficient of a coolant and δ represents the liquid film thickness of a refrigerant condensed on the inner wall surface 11a of the tube 10. FIG. 2 shows how a condensate flows through a horizontal tube with a plain inner surface. In FIG. 2, a reference numeral 13 designates a film of condensate.

Figure 3:
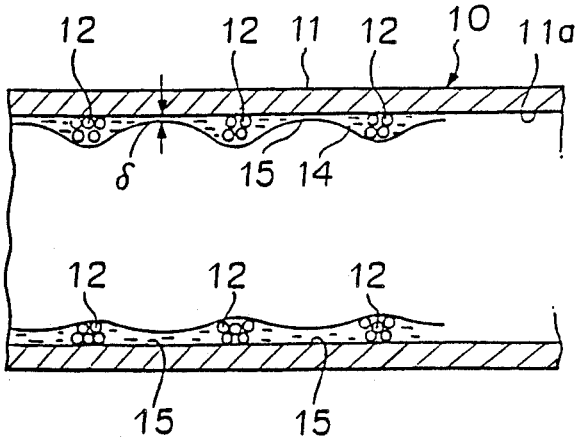

In the tube 10 according to the present invention, the projected parts 12 formed by a porous layer attract the condensate film 13 between the adjacent projected parts 12 by capillary effect as shown in FIG. 3 to thin the film as shown at 14 on the plain parts 15 on the inner wall surface 11a of the tube 10. That improves the heat transfer characteristics as seen from the equation (4). Such effect has been proved by an experiment where a heat exchanger tube with a single wire wound around its outer wall surface is used (see "Heat Transfer Enhancement for Gravity Controlled Condensation on a Horizontal Tube by a Coiled Wire" on page 2436 of "Transactions of the Japanese Society of Mechanical Engineering" vol. 51, No. 467, 1985-7).

Figure 4A:
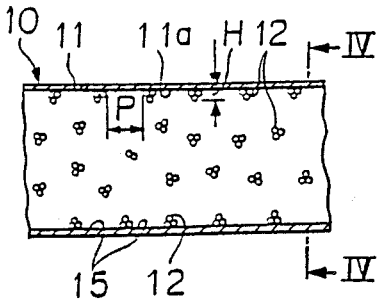
Figure 4B:
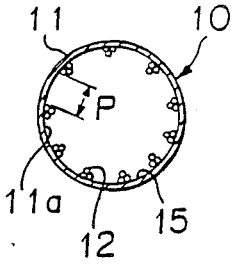

A second embodiment of the present invention will be explained with reference to FIGS. 4(*a*) and (*b*). In the second embodiment, the projected parts 12 formed by a porous layer are provided on the inner surface 11a of the tube so as to be scattered in a stagger. The positions of the projected parts are determined so that the intervals P between the adjacent projected parts 12 and the height H of the projected parts from the plain surface parts 15 of the inner wall satisfy with the expressions (1) and (3). The tube 10 having such structure offers advantage similar to the first embodiment. When the tube 10 of this embodiment is used as a condensor, the condensate which has been collected on the projected parts 12 by capillary effect drops from the projected parts 12.

A third embodiment of the present invention will be described with reference to FIGS. 5(*a*) and (*b*). In the third embodiment, the projected parts 12 are provided on the inner wall surface 11*a* of the 10 in a spiral form. The intervals P between the projected parts 12 and the height H of the projected parts are determined so as to satisfy the expressions (1) and (3).

Figure 6A:
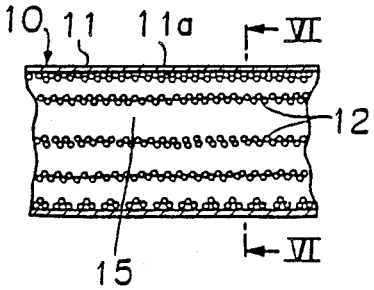
Figure 6B:
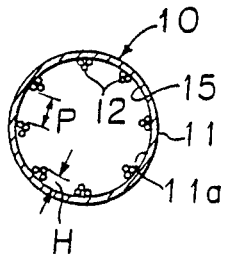

A fourth embodiment of the present invention will be explained with reference to FIGS. 6(*a*) and (*b*). In the embodiment fourth, the projected parts 12 are formed on the inner surface 11a of the tube 10 in the axial direction. The intervals P and the height H are determined so as to satisfy the expressions (1) and (3). When the tube 10 is used as a condensor, the condensate which has been collected on the projected parts 12 by capillary effect can drop more easily. As a result, it is possible to obtain advantage similar to the first embodiment.

Figure 7A:
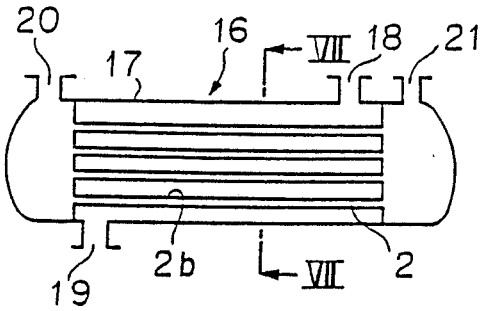
Figure 7B:
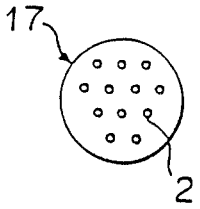

Although the heat exchanger tube 10 has the projected parts 12 provided on the inner walll surface 11*a* of the tubular body 11 in the first to fourth embodiments, a shell and tube type of heat exchanger 16 as shown in FIG. 7 is sometimes used in a heat pump type of air-conditioning and heating apparatus for business purpose when a single heat exchanger is used to feed cooled and heated water. In FIGS. 7(*a*) and (*b*), a reference numeral 17 designates a shell for housing heat exchanger tubes 2. A reference numeral 18 designates an inlet for evaporated refrigerant, formed in the shell 17. A reference numeral 19 designates an outlet for the condensate; 20, an inlet for water; and 21, an outlet for heated water. In the heat exchanger 16 having such structure, in order to heat water, the evaporated refrigerant comes into the shell 17 through the inlet 18, and it is condensed on the outer wall surfaces 2b of the tubes 2. Then it flows out from the outlet 19. Water to be heated is supplied into the shell 17 through the inlet 20, and it is heated by condensation latent heat while flowing through the tubes 2. Then the heated water flows out from the outlet 21. On the other hand, in order to cool water, a refrigerant comes into the shell 17 through the inlet 19 which is used as the outlet for condensate at the time of supplying heated water, and it is evaporated on the outer surfaces 2*b* of the tubes 2. Then it is taken out from the shell 17 through the outlet 18 which is used as the inlet for evaporated refrigerant at the time of supplying heated water. In this case, water is supplied into the shell 17 through the inlet 20 for water, and it is cooled by vaporization of the refrigerant while flowing through the tubes 2. Then cooled water is taken out from the outlet 21.

With respect to such exchanger 16, it is important to improve both evaporating heat transfer characteristics and condensing heat transfer characteristics on the outer surface 2*b* of the tube 2.

Figure 8A:
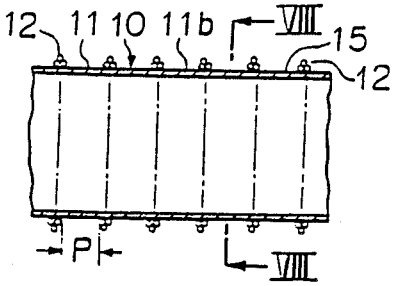
Figure 8B:
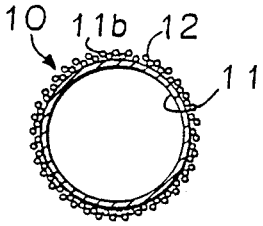

A fifth embodiment of the present invention will be described with reference to FIGS. 8(*a*) and (b). The projected parts 12 which are formed by a porous layer like the first embodiment are provided on the outer surface 11*b* of the heat exchanger tube 10.

The projected parts 12 are provided on the outer surface 11*b* of the tubular body 11 in the circumferential direction so that the intervals P and the height A satisfy the expressions (1) and (3) as with the first embodiment. It is possible to obtain advantage similar to the first embodiment.

Figure 9A:
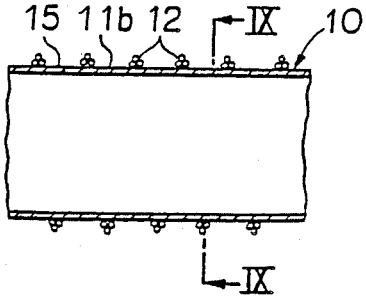
Figure 9B:
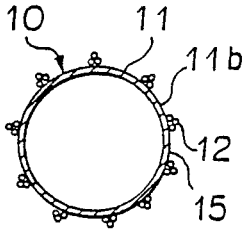

A sixth embodiment of the present invention will be described with reference to FIGS. 9(*a*) and (*b*). The projected parts 12 are provided on the outer surface 11*b* so that they are scattered in a stagger like the second embodiment. Advantage similar to the second embodiment can be offered.

Figure 5A:
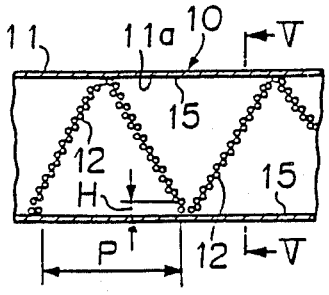
Figure 5B:
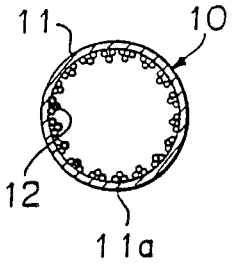

The projected parts 12 can be provided on the outer surface 11*b* in a spiral form or in the axial direction like the third or fourth embodiments as shown in FIGS. 5(*a*) to 6(*b*) to obtain similar advantage.

By the way, if the intervals P between the adjacent projection arrays of the projected parts 12 are exceedingly shortened, the heat transfer characteristics are extremely deteriorated because the thin liquid film part 14 as shown in FIG. 3 becomes small.

Figure 10A:
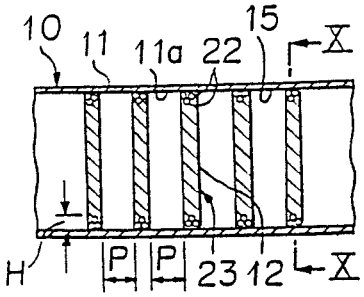
Figure 10B:
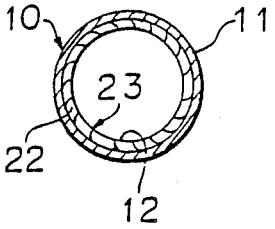
Figure 11A:
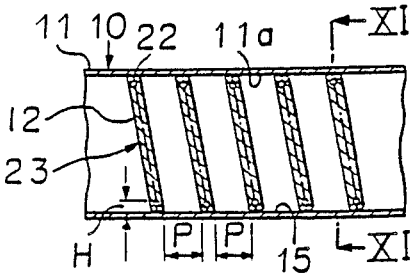
Figure 11B:
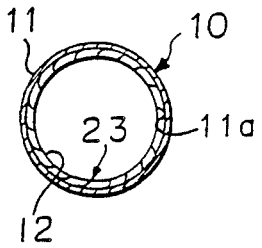
Figure 12A:
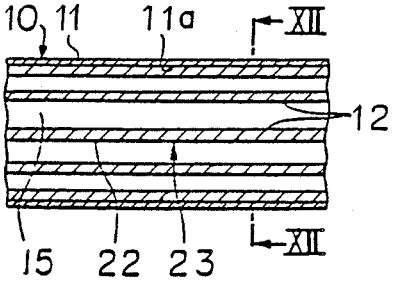
Figure 12B:
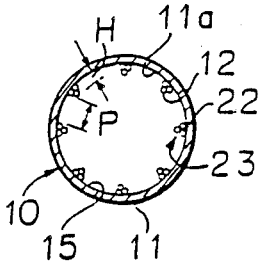
Figure 13A:
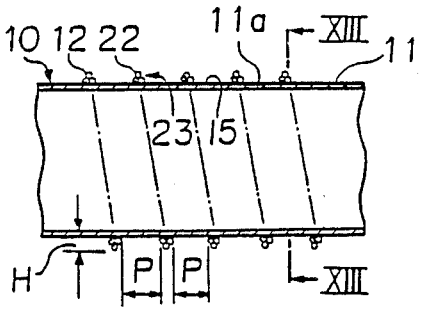
Figure 13B:
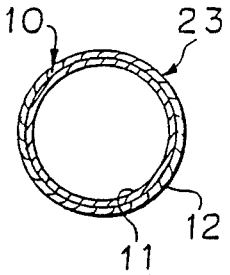
Figure 14A:
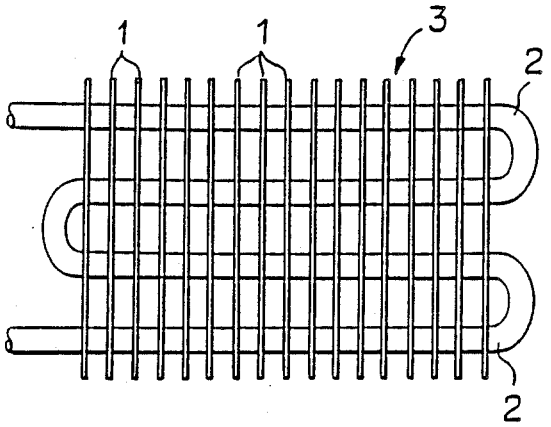
FIGURE 14(a) PRIOR ART
Figure 14B:
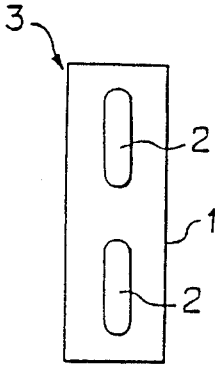
FIGURE 14(b) PRIOR ART
Figure 15A:
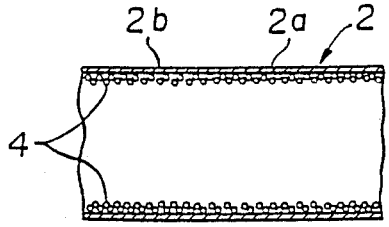
FIGURE 15(a) PRIOR ART
Figure 15B:
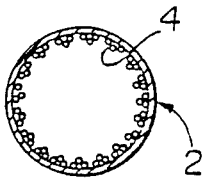
FIGURE 15(b) PRIOR ART
Figure 16A:
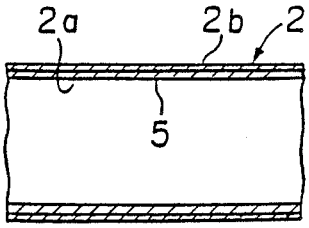
FIGURE 16(a) PRIOR ART
FIG. 16(a) is a fragmentary longitudinal cross section and FIG. 16(b) is a transverse cross section and, FIGS. 17(*a*) and 17(*b*) illustrate a conventional condensing tube, wherein FIG. 17(*a*) is a fragmentary longitudinal cross section
Figure 16B:
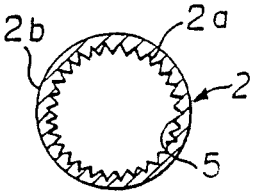
FIGURE 16(b) PRIOR ART
Figure 17A:
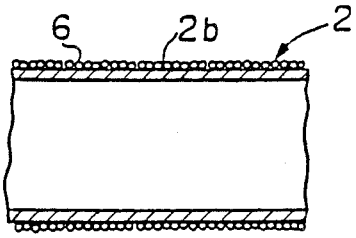
FIGURE 17(a) PRIOR ART
FIG. 17(b) is a transverse cross section.
Figure 17B:
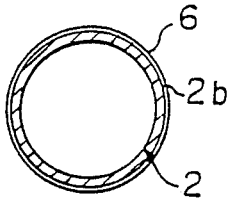
FIGURE 17(b) PRIOR ART

In the first to sixth embodiments, the projected part or surface 12 provided on the inner or outer wall surfaces 11a or 11b of the tubular body 11 is formed by a porous layer. The projected part 12 can be made of a stranded wire 23 comprising a plurality of steel wires 22 like a seventh to ninth embodiments as shown in FIGS. 10(*a*) through 12(*b*). The projected surfaces 12 are provided on the inner wall surface 11*a* of the tubular body 11 so that the intervals P between the projected surfaces 12 and the height H of the projected surfaces from the plain surface 15 formed on the inner wall surface 11*a* of the tubular body 11 satisfies the expressions (1) and (3). These embodiments can offer advantage similar to the embodiments as already described, since the spaces formed between the steel wires 22 constituting the stranded wire 23 function like the porous layer.

The connection of the projected surfaces 12 are formed by the stranded wire 23 to the inner wall surface 11*a* can be done by use of the elastic action of the stranded wire 23. It facilitates the production and improves the mass productivity.

Although the projected surfaces 12 formed by stranded wires 23 are provided on the inner wall surface 11*a* of the tubular body 11 in the embodiments as shown in FIGS. 10(*a*) through 12(*b*), the projected surfaces 12 can be provided on the outer wall surface 11*b* of the tubular body 11. Such structure can also offer similar advantage.

In the embodiments as explained above, the projected surfaces with cavities are provided on either the inner wall surface of the tubular body or the outer wall surface. If desired, the projected surfaces can be provided on both inner wall surface and outer wall surface of the tubular body, which can offer similar advantage.

As explained above, in accordance with the present invention, a heat exchanger tube has such construction that the projected surfaces are provided on at least one of the inner wall surface of the tubular body and the outer wall surface, and the projected surfaces and the plain surfaces formed on the wall surfaces mingle together. Accordingly, it is possible that a single heat exchanger improves both evaporating heat transfer characteristics and condensing heat transfer characteristics. In addition, one type of heat exchanger tube can be produced to be applicable to both evaporator and condensor though two kinds of heat exchanger tubes (i.e., the one for an evaporator and the one for a condensor) have been separately produced. The present invention offers excellent economical merit, such as the improvement of mass productivity.

Obviously, numerous modifications and variations of the present invention are possible in light of the above teachings. It is therefore to be understood that, within the scope of the appended claims, the invention may be practiced otherwise than as specifically described herein.

We claim:

1. A heat exchanger tube for evaporation or condensation, said heat exchanger tube comprising:

(a) projected parts having cavities in which bubble nuclei form, said projected parts being provided on at least one of the inner wall surface and the outer wall surface of a tubular body, and (b) plain parts formed on the same surface as the projected parts so that the projected parts and the plain parts are interspersed, wherein:

(c) the projected parts and the cavities comprise a stranded wire made of a plurality of wires and (d) the projected parts are provided on the wall surface so that the intervals P between the projected parts and the height H of the projected parts satisfy the following expressions:

$$P \leqq 4d, \quad 10 \leqq P/H \leqq 20$$

wherein d represents the diameter of a bubble nucleus.

* * * * *